US008207995B2

(12) United States Patent
Tamaru et al.

(10) Patent No.: US 8,207,995 B2
(45) Date of Patent: Jun. 26, 2012

(54) IMAGE FORMING APPARATUS

(75) Inventors: Yasuo Tamaru, Nagoya (JP); Junichi Yokoi, Toyoake (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 514 days.

(21) Appl. No.: 12/409,835

(22) Filed: Mar. 24, 2009

(65) Prior Publication Data

US 2009/0322850 A1 Dec. 31, 2009

(30) Foreign Application Priority Data

Jun. 30, 2008 (JP) ..... 2008-170819
Jun. 30, 2008 (JP) ..... 2008-171166

(51) Int. Cl.
*B41J 15/14* (2006.01)

(52) U.S. Cl. ..... 347/242; 347/257

(58) Field of Classification Search ..... 347/238, 347/242, 257, 263

See application file for complete search history.

(56) References Cited

U.S. PATENT DOCUMENTS

| | | | | |
|---|---|---|---|---|
| 4,258,372 | A * | 3/1981 | Ishikawa | 347/149 |
| 5,339,132 | A | 8/1994 | Tomita et al. | |
| 6,055,006 | A * | 4/2000 | Murano | 347/118 |
| 6,801,232 | B2 | 10/2004 | Nagamine et al. | |
| 7,589,751 | B2 * | 9/2009 | Fukutome et al. | 347/138 |
| 7,825,946 | B2 * | 11/2010 | Sugiyama et al. | 347/242 |
| 2002/0149664 | A1 | 10/2002 | Nagamine et al. | |
| 2006/0176538 | A1 | 8/2006 | Hirayama et al. | |
| 2008/0038551 | A1 | 2/2008 | Shintani | |
| 2009/0169249 | A1 * | 7/2009 | Watanabe et al. | 399/114 |
| 2011/0133735 | A1 | 6/2011 | Yokosawa et al. | |

FOREIGN PATENT DOCUMENTS

| | | | |
|---|---|---|---|
| JP | 5-19602 | A | 1/1993 |
| JP | 8-262948 | A | 10/1996 |
| JP | 2000-255100 | A | 9/2000 |
| JP | 2001-130047 | * | 5/2001 |
| JP | 2001-228658 | A | 8/2001 |
| JP | 2002-225339 | | 8/2002 |
| JP | 2002-361931 | | 12/2002 |
| JP | 2003-039732 | A | 2/2003 |
| JP | 2005-055781 | | 3/2005 |
| JP | 2006-011267 | A | 1/2006 |
| JP | 2006-218681 | A | 8/2006 |
| JP | 2008-134644 | A | 6/2008 |

OTHER PUBLICATIONS

Machine translation of JP-2001-130047.*
JP 2007-076028 Machine translation, Inventor: Gomi Tsugio, Assignee: Seiko, Date of Pub. Mar. 29, 2007, 25 pages.*
Decision of Patent Grant dispatched Apr. 26, 2011 in Japanese Application No. 2008-170819 and English translation thereof.

* cited by examiner

*Primary Examiner* — Julian Huffman
*Assistant Examiner* — Sharon A Polk
(74) *Attorney, Agent, or Firm* — Banner & Witcoff, Ltd.

(57) ABSTRACT

An image forming apparatus is provided, which includes: a photosensitive member; an exposure member; a gap keeping member; a positioning member and a swing regulating member. The swing regulating member is configured to come in contact with the exposure member at a contact position that is more upstream than the exposure member and that is more separated from the photosensitive member than a contact position between the positioning member and the exposure member.

13 Claims, 11 Drawing Sheets

UP
DOWN
FRONT
REAR
LEFT
RIGHT
14
47
43
40
10
44
53
100
110L
120L
130L
430BL(430BR)
43BL
(43BR)
200L
(200R)
100L
100R
110R
120R

IMAGE FORMING APPARATUS

CROSS REFERENCE TO RELATED APPLICATION

The present disclosure relates to the subject matter contained in Japanese Patent Application Nos. 2008-170819 (filed on Jun. 30, 2008) and 2008-171166 (filed on Jun. 30, 2008), each of which is expressly incorporated herein by reference in its entirety.

TECHNICAL FIELD

The present invention relates to an image forming apparatus exposing a photosensitive member such as a photosensitive drum by the use of an exposure member having plural light emitting portions such as LED heads.

BACKGROUND ART

JP-A-2002-361931 discloses an image forming apparatus exposing a photosensitive drum by the use of an LED head, in which a spacer maintaining a gap in an optical axis direction between the LED head and the photosensitive drum is disposed between the LED head and the photosensitive drum. In the image forming apparatus, the spacer is formed integral with the LED head.

Since the spacer is formed integral with the LED head, the spacer coming in slide-contact with the rotating photosensitive drum may be attracted in a rotation direction of the photosensitive drum due to the friction with the photosensitive drum and thus the LED head may move in the rotation direction. Accordingly, it can be considered that a positioning member is disposed downstream of the LED head in the rotation direction to regulate the position of the LED head in the rotation direction. However, when the spacer is attracted in the rotation direction of the photosensitive drum, the LED head may be inclined about the positioning member. In this way, when the LED head is inclined, the gap in the optical axis direction between the photosensitive drum and the LED head varies. When the photosensitive drum rotates and comes in slide-contact with the spacer and thus the spacer is abraded, the gap in the optical axis direction between the photosensitive drum and the LED head varies. As a result, since a focal position of light emitted from the LED head is changed, the image quality is deteriorated.

SUMMARY

The invention provides at least the following aspects.

(1) An image forming apparatus including: a photosensitive member; an exposure member; a gap keeping member; a positioning member and a swing regulating member, wherein the swing regulating member is configured to come in contact with the exposure member at a contact position that is more upstream than the exposure member that is more separated from the photosensitive member than a contact position between the positioning member and the exposure member.

(2) An image forming apparatus including: a photosensitive drum; an exposure member; a gap keeping member; a positioning member; and a pressing member, wherein the exposure member, the positioning member, and the pressing member are configured so that an angle formed by a straight line connecting a center axis of the photosensitive drum and an exposure position of the photosensitive drum and an optical axis of light emitted from the exposure member increases as an abrasion of the gap keeping member and an abrasion of the exposure member or the positioning member increase.

Therefore, an advantage of the invention is to improve image quality by suppressing a variation in gap in the optical axis direction between the photosensitive member and the exposure member.

This and other advantages of the invention will be discussed with reference to the accompanying drawings.

DESCRIPTION OF THE PREFERRED EMBODIMENT

First Embodiment

Figure 1:
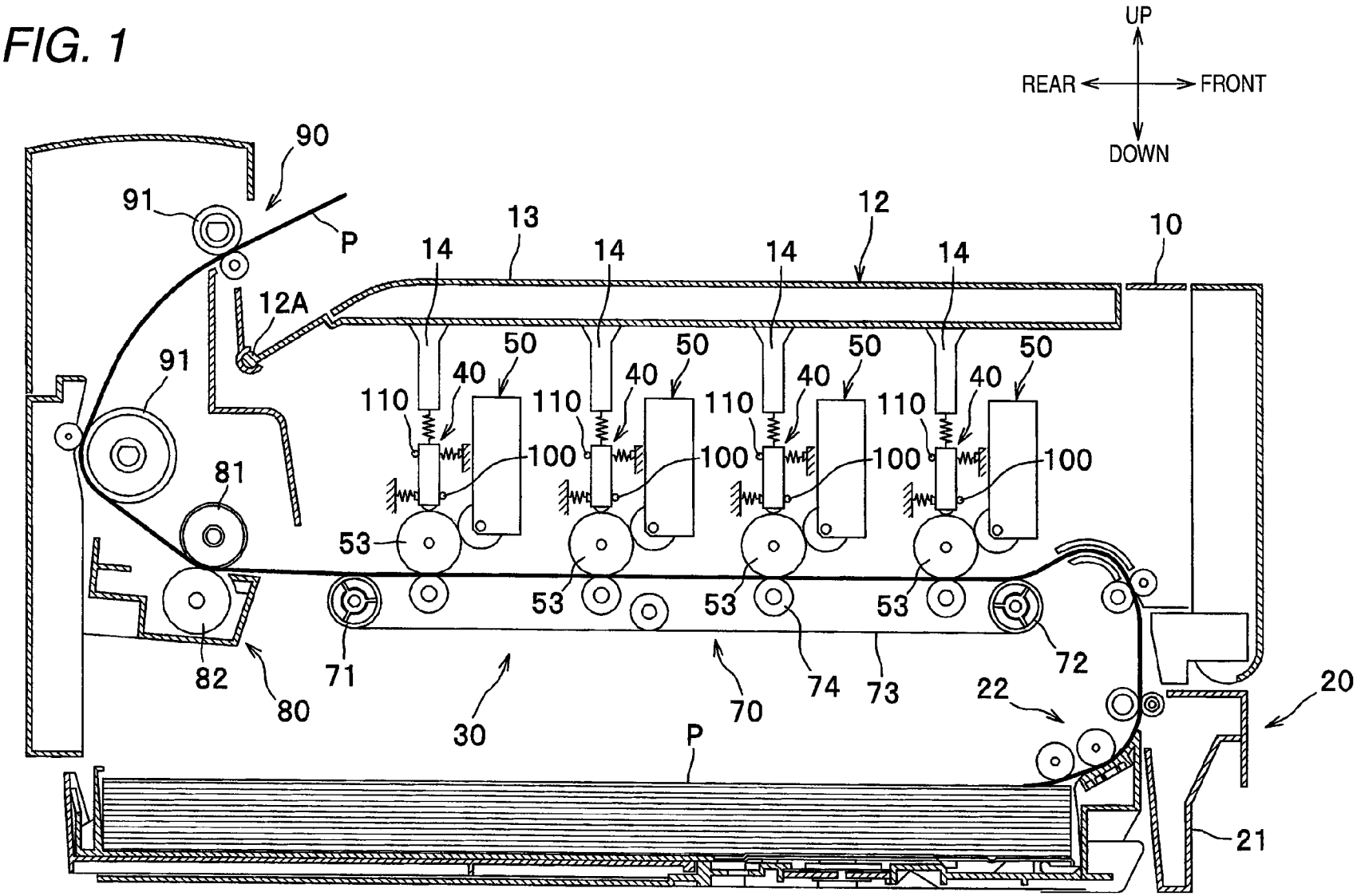
FIG. 1 is a sectional view illustrating the entire configuration of a color printer according to a first embodiment of the invention.

A first embodiment of the invention will be described in detail with reference to the accompanying drawings. FIG. 1 is a sectional view illustrating the entire configuration of a color printer.

In the following description, directions are described based on a user using the color printer. That is, in FIG. 1, the right side as facing the plane of paper is "front (near side)", the left side as facing the plane of paper is "rear (deep side)", the deep side as facing the plane of paper is "right", and the near side as facing the plane of paper is "left." The vertical direction as facing the plane of paper is "vertical direction."

As shown in FIG. 1, the color printer 1 includes a sheet feed unit 20 feeding a sheet P, an image forming unit 30 forming an image on the fed sheet P, and a sheet discharge unit 90 discharging the sheet P having the image formed thereon in a main chassis 10.

The upper portion of the main chassis 10 is provided with an upper cover 12 being freely opened and closed relative to the main chassis 10 so as to be vertically rotatable about a hinge 12A disposed in the rear side. The top surface of the upper cover 12 serves as a sheet discharge tray 13 on which the sheets P discharged from the main chassis 10 are piled and the bottom surface thereof is provided with plural LED attachment members 14 holding LED units 40 to be described later.

The sheet feed unit 20 is disposed in the lower portion of the main chassis 10 and includes a sheet feed tray 21 detachably attached to the main chassis 10 and a sheet feed mechanism 22 transporting the sheet P from the sheet feed tray 21 to the image forming unit 30. In the sheet feed unit 20 having the above-mentioned configuration, the sheets P in the sheet feed tray 21 are separated sheet by sheet by the sheet feed mechanism 22 and are fed to the image forming unit 30.

The image forming unit 30 includes four LED units 40, four process cartridges 50, a transfer unit 70, and a fixing unit 80.

The LED units 40 are supported by the LED attachment members 14, respectively, and are properly positioned by positioning members 100 or swing regulating members 110 disposed in the main chassis 10. The detailed structures of the LED units 40, the positioning members 100, and the swing regulating members 110 are described later.

The process cartridges 50 are disposed parallel in the front and rear directions between the upper cover 12 and the sheet feed unit 20 and each includes a photosensitive drum 53 rotatably supported by the main chassis 10, a charger not shown, a known developing roller of which the reference numeral is omitted, and a toner containing chamber. The photosensitive drum 53 has a cylindrical surface.

The transfer unit 70 is disposed between the sheet feed unit 20 and the process cartridges 50 and includes a driving roller 71, a driven roller 72, a transport belt 73, and a transfer roller 74.

The driving roller 71 and the driven roller 72 are separated in the front and rear directions from each other in parallel and a transport belt 73 formed of an endless belt is suspended therebetween. The outer surface of the transport belt 73 is in contact with the respective photosensitive drums 53. Four transfer rollers 74 nipping the transport belt 73 along with the corresponding photosensitive drums 53 are disposed inside the transport belt 73 to face the corresponding photosensitive drums 53. At the time of transfer, a transfer bias is applied to the transfer rollers 74 by a static current control.

The fixing unit 80 is disposed in a deep side of the process cartridges 50 and the transfer unit 70 and includes a heating roller 81 and a pressing roller 82 disposed to face the heating roller 81 and to press the heating roller 81.

In the image forming unit 30 having the above-mentioned configuration, the surfaces of the photosensitive drums 53 are uniformly charged by the chargers and then are exposed by the LED units 40. Accordingly, the potential of the exposed portion is lowered and thus electrostatic latent images based on image data are formed on the photosensitive drums 53. Thereafter, toner is supplied to the electrostatic latent images from the developing roller, whereby toner images are formed on the photosensitive drums 53.

Then, a sheet P fed onto the transport belt 73 passes between the photosensitive drums 53 and the transfer rollers 74 disposed inside the transport belt 73, whereby the toner images formed on the photosensitive drums 53 are transferred onto the sheet P. Then, the sheet P passes between the heating roller 81 and the pressing roller 82, whereby the toner images transferred onto the sheet P are thermally fixed.

The sheet discharge unit 90 includes plural pairs of transport rollers 91 transporting the sheet P. The sheet P onto which the toner images are transferred and are thermally fixed is transported by the transport rollers 91 and is discharged out of the main chassis 10 and piled on the sheet discharge tray 13.

Configurations of LED Unit, Positioning Member, and Swing Regulating Member

The configurations of the LED units 40, the positioning members 100, and the swing regulating members 110 will be described in detail.

Configuration of LED Unit

The configuration of each LED unit 40 will be first described. In the drawings, FIG. 2 is a front view illustrating the configuration of the LED unit, FIG. 3(*a*) is an exploded perspective view illustrating a left eccentric cam, and FIG. 3(*b*) is an exploded perspective view illustrating a right eccentric cam.

Figure 2:
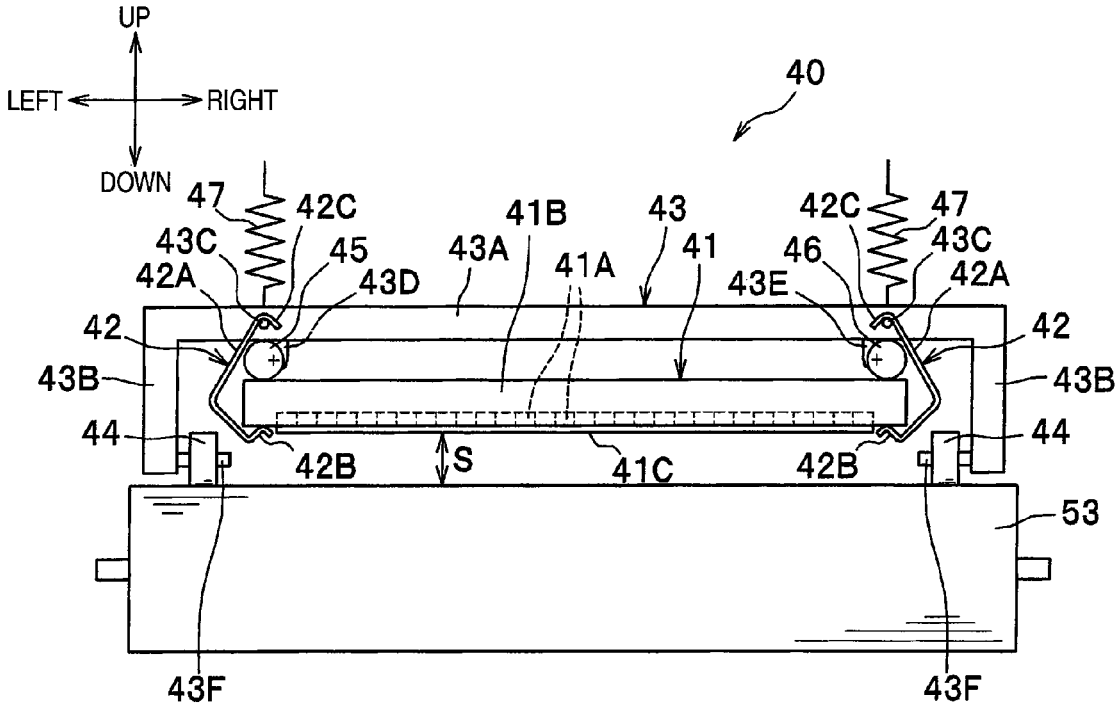
FIG. 2 is a front view illustrating a configuration of an LED unit.

As shown in FIG. 2, the LED unit 40 includes an LED head 41, two line springs 42, a support frame 43 made of resin, two guide rollers 44, and two eccentric cams 45 and 46.

The LED head 41 includes plural LED arrays 41A in which plural LEDs are arranged in a semiconductor chip, a head frame 41B, and a lens array 41C.

The plural LED arrays 41A are arranged in a line with a predetermined pixel pitch in the lateral directions (the axis direction of the photosensitive drum 53) and properly emit light by the selective driving to emit light to the photosensitive drum 53. Specifically, each LED array 41A emits light in response to signals from a controller not shown on the basis of data of images to be formed to expose the photosensitive drum 53.

The head frame 41B is formed of resin and the plural LED arrays 41A are supported in the bottom portion. Since the head frame 41B is formed of resin, a decrease in size and cost of the LED head 41 is accomplished and the electric discharge from high-voltage components such as the charger is suppressed.

The lens array 41C includes plural SELFOC lenses (registered trademark) arranged to correspond to the LED arrays 41A, extends in the arrangement direction of the LED arrays 41A, and is fixed to the head frame 41B in a state where both ends of the bottom surface of the head frame 41B are slightly left.

The line spring 42 is a linear attracting spring having a substantially V shape and urges the LED head 41 to the support frame 43. Specifically, the line spring 42 includes a body portion 42A having a V shape, an operating portion 42B formed at a lower end of the body portion 42A, and an engagement pawl 42C formed at the upper end of the body portion 42A.

The body portion 42A is curved in a V shape so as to expose operation portions (cross grooves 45C and 46C to be described later; see FIGS. 3(*a*) and 3(*b*)) the eccentric cams 45 and 46 to be described later.

The operating portion 42B is a portion applying a pressing force to the LED head 41 and is in contact with a portion on the bottom surface of the head frame 41B located outside the plural LED arrays 41A (lens array 41C) in the lateral directions. The operating portion 42B is bent upward and then curved downward to form a V shape. Accordingly, the contact portion between the operating portion 42B and the head frame 41B has substantially a point shape.

The engagement pawl 42C has a V shape so as to be hooked on the top surface of an engagement pin 43*c* of the support frame 43 to be described later.

The support frame 43 supports the LED head 41 via the line spring 42 and includes a base portion 43A extending in the lateral direction and a pair of extension portions 43B extending downward from both ends of the base portion 43A.

In the base portion 43A, the engagement pins 43C supporting the line spring 42 and the bearing portions 43D and 43E supporting the eccentric cams 45 and 46 are formed at two symmetric positions, respectively. Two coil springs 47 pressing down the support frame 43 to the photosensitive drum 53 are disposed at symmetric positions on the top surface of the base portion 43A. Accordingly, the support frame 43 is pressed with good balance in the lateral direction by the two coil springs 47.

Each extension portion 43B has such a length that the extension portion more protrudes downward than the bottom surface of the LED head 41 supported by the base portion 43A via the line spring 42. A shaft 43F rotatably supporting the guide roller 44 is disposed at the lower end thereof.

Each guide roller 44 is a cylindrical member and disposed rotatable about the shaft 43F located at the lower end of the extension portion 43B of the support frame 43. That is, the guide roller is separated from the LED head 41 by a predetermined distance. The guide rollers 44 are pressed to the photosensitive drum 53 with the urging force transmitted from the coil springs 47 through the support frame 43 and rotates with the rotation of the photosensitive drum 53. When the guide rollers 44 come in contact with the photosensitive drum 53 and thus the photosensitive drum 53 is decentered, the gap (operating distance S) in the optical axis direction between the photosensitive drum 53 and the LED head 41 supported by the support frame 43 is kept.

In other words, the guide rollers 44 keep the gap between the LED head 41 and the photosensitive drum 53 by the use of the support frame 43. That is, the gap between the support frame 43 and the photosensitive drum 53 is kept by the guide rollers 44 and the LED head 41 is supported by the support frame 43 of which the gap from the photosensitive drum 53 is kept, whereby the gap between the LED head 41 and the photosensitive drum 53 is kept.

The guide rollers 44 may come in contact with a photosensitive layer (layer to be exposed) of the surface of the photosensitive drum 53 or may come in contact with the areas (areas having no photosensitive layer) outside the photosensitive layer in the lateral direction. The guide rollers 44 are formed of a material more easily abraded than the surface of the photosensitive drum 53 and come in contact with the uppermost portion (see FIG. 1) of the surface of the photosensitive drum 53 in an initial state.

The eccentric cams 45 and 46 are disposed between the LED head 41 and the base portion 43A of the support frame 43 and press the LED head 41 in the optical axis direction with the urging of the line spring 42. Specifically, the eccentric cams 45 and 46 are disposed at positions coming in contact with the portions outside the plural LED arrays 41A (lens array 41C) on the top surface of the head frame 41B so as to overlap with the operating portion 42B of the line spring 42 as viewed in the urging direction (vertical direction) of the line spring 42.

Figure 3:
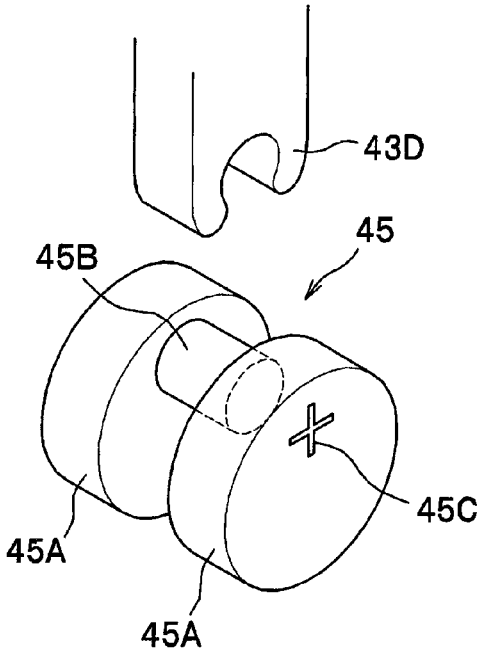
FIG. 3(*a*) is an exploded perspective view illustrating a left eccentric cam and FIG. 3(*b*) is an exploded perspective view illustrating a right eccentric cam.
Figure 3:
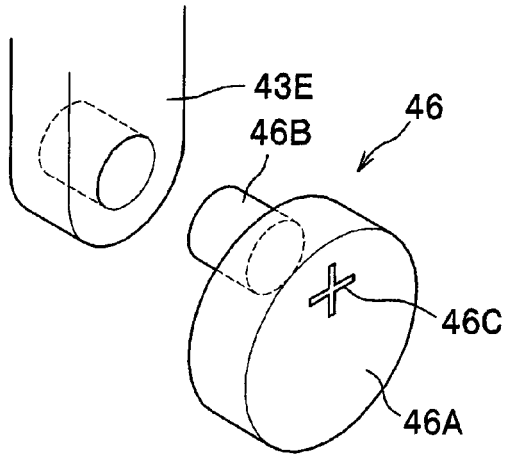

As shown in FIG. 3(*a*), the left eccentric cam 45 of the pair of eccentric cams 45 and 46 presses the LED head 41 at two positions and as shown in FIG. 3(*b*), the right eccentric cam 46 presses the LED head 41 at one position. That is, all the eccentric cams 45 and 46 and the LED head 41 come in contact with each other at three positions.

Specifically, as shown in FIG. 3(*a*), the left eccentric cam 45 includes two cylindrical portions 45A disposed coaxially and one shaft 45B connecting the cylindrical portions 45A at a position departing from the centers of the cylindrical portions 45A.

The shaft 45B of the eccentric cam 45 is inserted into a C-shaped bearing portion 43D of the support frame 43 and thus is rotatably supported by the bearing portion 43D with predetermined tightness (hardly to move). Here, the tightness between the shaft 45B and the bearing portion 43D is set to such an extent that the eccentric cam 45 does not rotate with the urging force of the line spring 42.

A cross groove 45C of which the center corresponds to the center of the shaft 45B is formed on an end surface of the cylindrical portion 45A of the eccentric cam 45. By allowing a plus driver to engage with the cross groove 45C and turning the plus driver by a predetermined distance with a force greater than the urging force of the line spring 42, the eccentric cam 45 rotates about the support frame 43 by the predetermined distance and is kept at the position.

As shown in FIG. 3(*b*), the right eccentric cam 46 has a shape obtained by removing one cylindrical portion 45A from the left eccentric cam 45. That is, the right eccentric cam 46 includes a cylindrical portion 46A, a shaft 46B, and a cross groove 46C, similarly to the left eccentric cam 45. The shaft 46B of the eccentric cam 46 is inserted into a substantially cylindrical bearing portion 43E of the support frame 43 and is rotatably supported by the bearing portion 43E with the same tightness as described above.

In the LED unit 40 having the above-mentioned configuration, as shown in FIG. 2, the guide rollers 44 come in contact with the photosensitive drum 53, whereby the support frame 43 is located at a predetermined position relative to the photosensitive drum 53. The LED head 41 is pressed against the eccentric cam 45 and 46 supported by the support frame 43 positioned as described above, whereby the LED head 41 is positioned relative to the photosensitive drum 53.

By properly operating the eccentric cams 45 and 46 in this state, the LED head 41 goes ahead and back relative to the support frame 43 and thus the operating distance S is minutely adjusted. Since the operating distance S greatly varies due to the influence of manufacturing errors of the guide rollers 44, the support frame 43, the eccentric cams 45 and 46, and the LED head 41, the operating distance S may not be set to a desired value with only the adjustment range of the eccentric cams 45 and 46. In this case, a coarse adjustment plate coarsely adjusting the operating distance S may be properly disposed between the eccentric cams 45 and 46 and the LED head 41.

The adjustment of the operating distance S is made at the time of manufacturing the LED unit 40 and is not made after the LED unit 40 is assembled into the main chassis 10. Therefore, after the operating distance S is adjusted, the LED head 41 is fixed to the support frame 43 by the use of a fixing member such as a coupling band or an adhesive not being elastically deformed and then the line spring 42 may be detached therefrom.

Configuration of Positioning Member and Swing Regulating Member

The configurations of the positioning member 100 and the swing regulating member 110 will be described now. In the drawings, FIGS. 4(*a*) and 4(*b*) are diagrams illustrating the positioning member and the swing regulating member, where FIG. 4(*a*) is a side view illustrating a state where the guide rollers of the LED unit are brought into contact with the photosensitive drum and FIG. 4(*b*) is a side view illustrating a state where the guide rollers of the LED unit are separated from the photosensitive drum.

Figure 4:
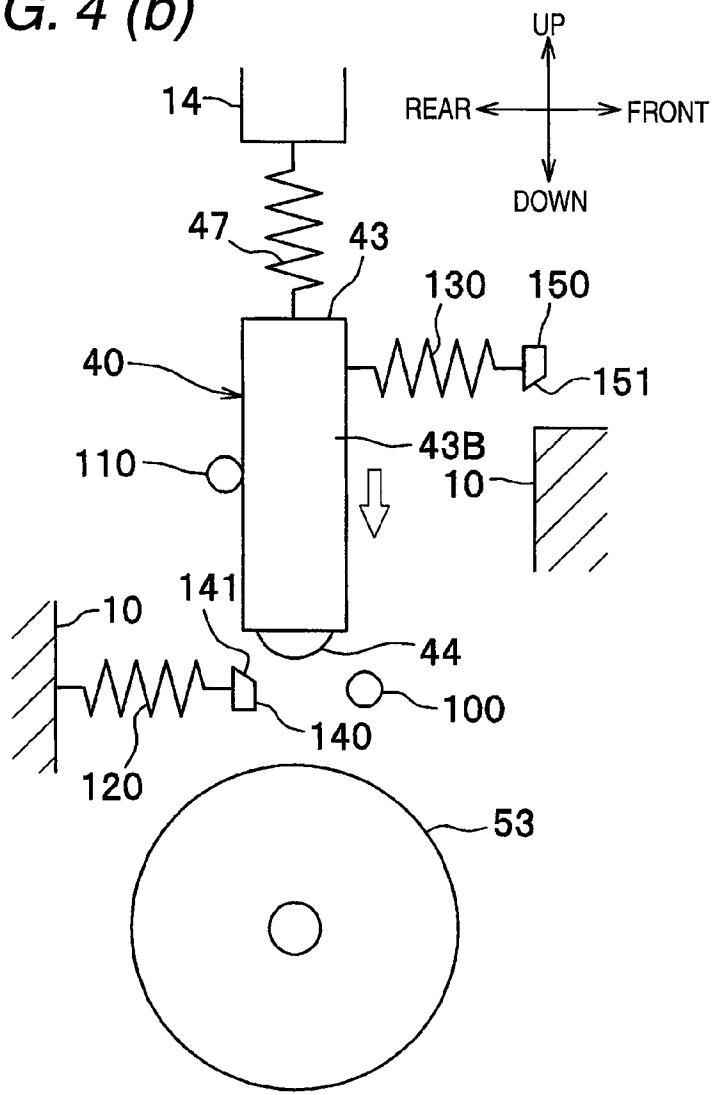
FIGS. 4(*a*) and 4(*b*) show a positioning member and a swing regulating member, where FIG. 4(*a*) is a side view illustrating a state where a guide roller of the LED unit is brought into contact with a photosensitive drum and FIG. 4(*b*) is a side view illustrating a state where the guide roller of the LED unit is separated from the photosensitive drum.
Figure 4:
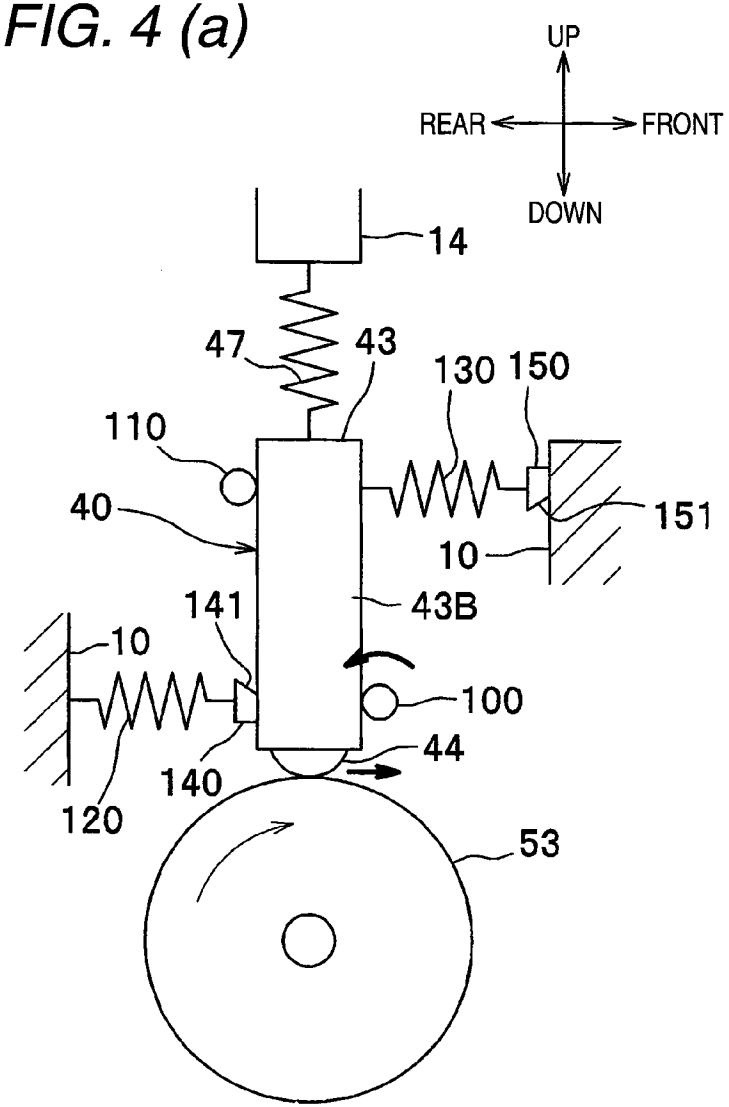

As shown in FIG. 4(*a*), the positioning member 100 is a cylindrical pin and is disposed in front of the LED unit 40 (downstream in the rotation direction of the photosensitive drum 53). Specifically, the positioning member 100 is disposed to face the front surface of the extension portion 43B of the support frame 43 constituting the LED unit 40.

The positioning member 100 positions the LED unit 40 in the front and rear directions (the rotation direction of the photosensitive drum 53) by coming in contact with the portion of the front surface of the extension portion 43B of the support frame 43 close to the photosensitive drum 53.

The swing regulating member 110 is a cylindrical pin and is disposed in the back of the LED unit 40 (upstream in the rotation direction of the photosensitive drum 53). Specifically, the swing regulating member 110 regulates the swing of the LED unit 40 about the positioning member 100 by coming in contact with a portion of the extension portion 43B of the support frame 43 above the position coming in contact with the positioning member 100 (in a direction getting apart from the photosensitive drum 53).

A first coil spring 120 is disposed on the opposite side of the positioning member 100 about the LED unit 40 and a second coil spring 130 is disposed on the opposite side of the swing regulating member 110 about the LED unit 40.

The first coil spring 120 is a spring fixed to the main chassis 10 to press the LED unit 40 (support frame 43) to the positioning member 100 and the front end thereof is provided with a contact member 140 coming in contact with the LED unit 40. The first coil spring 120 is disposed at the same position as the positioning member 100 in the vertical direction (optical axis direction). Specifically, the portion (an operating portion where the urging force of the first coil spring 120 is applied to the LED unit 40) of the contact member 140 coming in contact with the LED unit 40 is disposed at the same position as the portion of the positioning member 100 coming in contact with the LED unit 40 in the vertical direction.

The top of the contact member 140 is provided with a slope 141 inclined toward the photosensitive drum 53 as it goes from the first coil spring 120 to the LED unit 40. Accordingly, as shown in FIG. 4(*b*), when the LED unit 40 is made to move to the photosensitive drum 53, the LED unit 40 comes in contact with the slope 141 and the contact member 140 moves backward to compress the first coil spring 120 in the front and rear directions.

The second coil spring 130 is a spring fixed to the LED unit 40 (support frame 43) to press the LED unit 40 to the swing regulating member 110 and the front end thereof is provided with a contact member 150 coming in contact with the main chassis 10. The second coil spring 130 is disposed at the same position as the swing regulating member 110 in the vertical direction (optical axis direction). Specifically, the portion (an operating portion where the urging force of the second coil spring 130 is applied to the LED unit 40) of the second coil spring 130 fixed to the LED unit 40 is disposed at the same position as the portion of the swing regulating member 110 coming in contact with the LED unit 40 in the vertical direction.

The bottom of the contact member 150 is provided with a slope 151 inclined toward the photosensitive drum 53 as it goes from the main chassis 10 to the second coil spring 130. Accordingly, as shown in FIG. 4(*b*), when the LED unit 40 is made to move to the photosensitive drum 53, the slope 151 comes in contact with the main chassis 10 and the contact member 150 moves backward to compress the second coil spring 130 in the lateral direction.

Operations of Positioning Member and Swing Regulating Member

Operations of the positioning member 100 and the swing regulating member 110 will be described now.

As shown in FIG. 4(*a*), when the photosensitive drum 53 rotates, the guide roller 44 coming in contact with the photosensitive drum 53 is attracted in the rotation direction of the photosensitive drum 53 due to the friction with the photosensitive drum 53 and thus the LED unit 40 tends to move in the rotation direction, but this movement is regulated by the positioning member 100.

The LED unit 40 regulated by the positioning member 100 tends to swing about the positioning member 100 by the attraction of the guide roller 44 in the rotation direction of the photosensitive drum 53, but this swing is regulated by the swing regulating member 110. Accordingly, the LED unit 40 is kept at the initial position by the positioning member 100 and the swing regulating member 110.

According to the above-mentioned configuration of this embodiment, the following advantages can be obtained.

Even when the guide roller 44 is attracted in the rotation direction of the photosensitive drum 53 and thus the LED unit 40 tends to swing about the positioning member 100, the swing (inclination) of the LED unit 40 is suppressed by the swing regulating member 110. Accordingly, the focal position of light emitted from the LED unit 40 is prevented from varying, thereby improving the image quality.

Since the operating portion (the portion where the contact member 140 comes in contact with the LED unit 40) of the first coil spring 120 and the contact portion of the positioning member 100 with the LED unit 40 are disposed at the same position in the vertical direction, the LED unit 40 can be closely pressed on the positioning member 100 and thus can be satisfactorily positioned.

Since the operating portion (the portion where the second coil spring 130 is fixed to the LED unit 40) of the second coil spring 130 and the contact portion of the swing regulating member 110 with the LED unit 40 are disposed at the same position in the vertical direction, the LED unit 40 can be closely pressed on the swing regulating member 110 to satisfactorily suppress the swing of the LED unit 40.

Since the width in the front and rear directions of the lower portion of the LED unit 40 can be reduced by fixing the first coil spring 120 to the main chassis 10, the LED unit 40 can be made to excellently pass through a narrow gap between the positioning member 100 and the swing regulating member 110. Since the second coil spring 130 is fixed to the LED unit 40, the LED unit 40 can be made to excellently pass through a wide gap between the swing regulating member 110 and the main chassis 10, compared with a case where the second coil spring 130 is fixed to the main chassis 10.

The invention is not limited to the first embodiment, but may be modified in various forms as follows.

Figure 5:
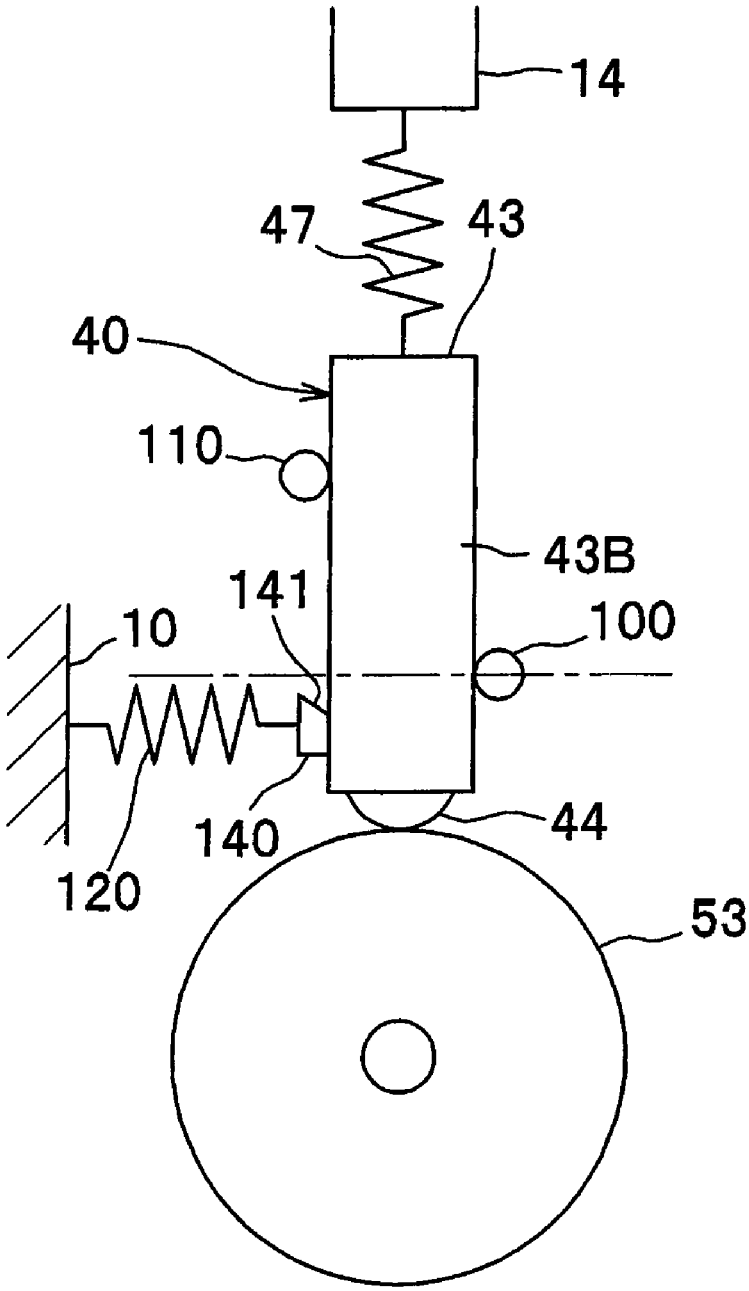
FIG. 5 is a side view illustrating an example where the LED unit is pressed by only a first coil spring.

In the first embodiment, the first coil spring 120 and the positioning member 100 are disposed at the same position in the vertical direction, but the invention is not limited to this configuration. For example, as shown in FIG. 5, the first coil spring 120 may be disposed at a position below the positioning member 100 (close to the photosensitive drum 53). Specifically, the operating portion (the portion where the contact member 140 comes in contact with the LED unit 40) of the first coil spring 120 may be disposed at a position below (close to the photosensitive drum 53) the contact portion of the positioning member 100 with the LED unit 40.

According to this configuration, the moment can be given to the LED unit 40 with the urging force of the first coil spring 120 and thus the LED unit 40 can be satisfactorily pressed to the positioning member 100 and the swing regulating member 110, thereby satisfactorily positioning the LED unit 40. Since the LED unit 40 can be pressed to the positioning member 100 and the swing regulating member 110 by the use of only the single first coil spring 120, the second coil spring 130 is not necessary, thereby accomplishing the decrease in cost.

Figure 6:
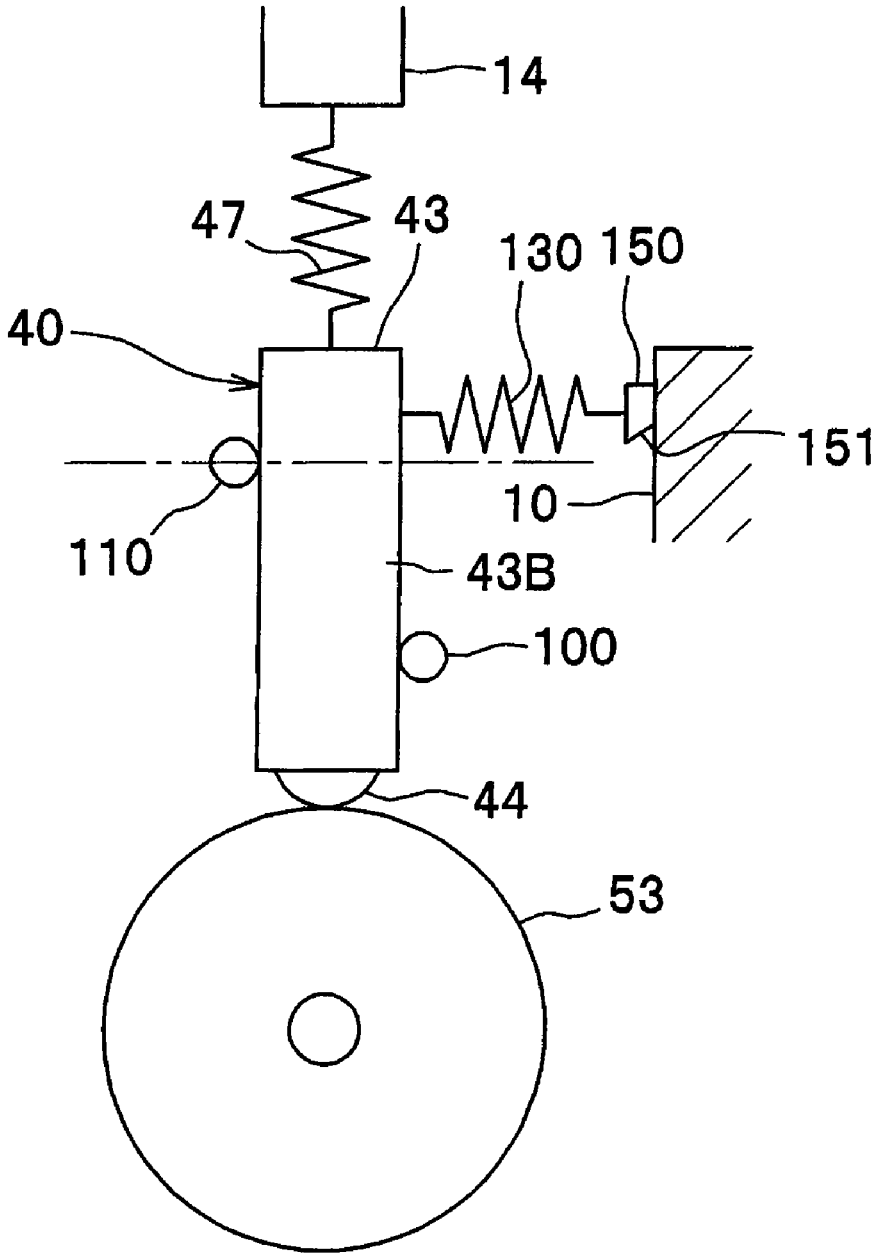
FIG. 6 is a side view illustrating an example where the LED unit is pressed by only a second coil spring.

In the first embodiment, the second coil spring 130 and the swing regulating member 110 are disposed at the same position in the vertical direction, but the invention is not limited to this configuration. For example, as shown in FIG. 6, the second coil spring 130 may be disposed at a position above the swing regulating member 110 (in the direction in which it gets apart from the photosensitive drum 53). Specifically, the operating portion (the portion where the second coil spring 130 is fixed to the LED unit 40) of the second coil spring 130 may be disposed above the contact portion of the swing regulating member 110 with the LED unit 40.

According to this configuration, the moment can be given to the LED unit 40 with the urging force of the second coil spring 130 and thus the LED unit 40 can be satisfactorily pressed to the positioning member 100 and the swing regulating member 110, thereby satisfactorily positioning the LED unit 40. Since the LED unit 40 can be pressed to the positioning member 100 and the swing regulating member 110 by the use of only the single second coil spring 130, the first coil spring 120 is not necessary, thereby accomplishing the decrease in cost.

In the first embodiment, the coil springs 120 and 130 are employed as the pressing member, but the invention is not limited to this configuration. For example, an elastic member such as a torsion spring or a leaf spring may be employed or a member other than the elastic member, such as an air cylinder or a solenoid driving an iron core with an electromagnetic force, may be employed.

The LED unit 40 may be disposed between the positioning member 100 and the swing regulating member 110 without disposing the pressing member. In this case, the force with which the lower end of the LED unit 40 is attracted forward due to the friction with the photosensitive drum 53 may be used to press and position the LED unit 40 to the positioning member 100 and the swing regulating member 110.

In the first embodiment, the positioning member 100 and the swing regulating member 110 are formed in a cylindrical shape, but the invention is not limited to this configuration. For example, they may be formed in a prism shape.

In the first embodiment, the LED unit 40 having the LED head 41 and the support frame 43 is employed as the exposure member, but the invention is not limited to this configuration. For example, the LED head 41 may be employed as the exposure member. That is, the guide rollers 44 may be rotatably disposed as the gap keeping member in the LED head 41 and the positioning member 100 and the swing regulating member 110 may be disposed to interpose the LED head 41 therebetween.

In the first embodiment, the rotatable guide rollers 44 are employed as the gap keeping member, but the invention is not limited to this configuration. For example, a non-rotatable member such as a spacer having a concave surface coming in surface contact with the outer circumferential surface of the photosensitive drum may be employed as the gap keeping member. By providing the gap keeping member, the operating distance can be maintained even when the photosensitive drum may be decentered.

In the first embodiment, the photosensitive drum 53 is employed as the photosensitive member, but the invention is not limited to this configuration. For example, a photosensitive member having a belt shape may be employed.

Second Embodiment

Figure 7:
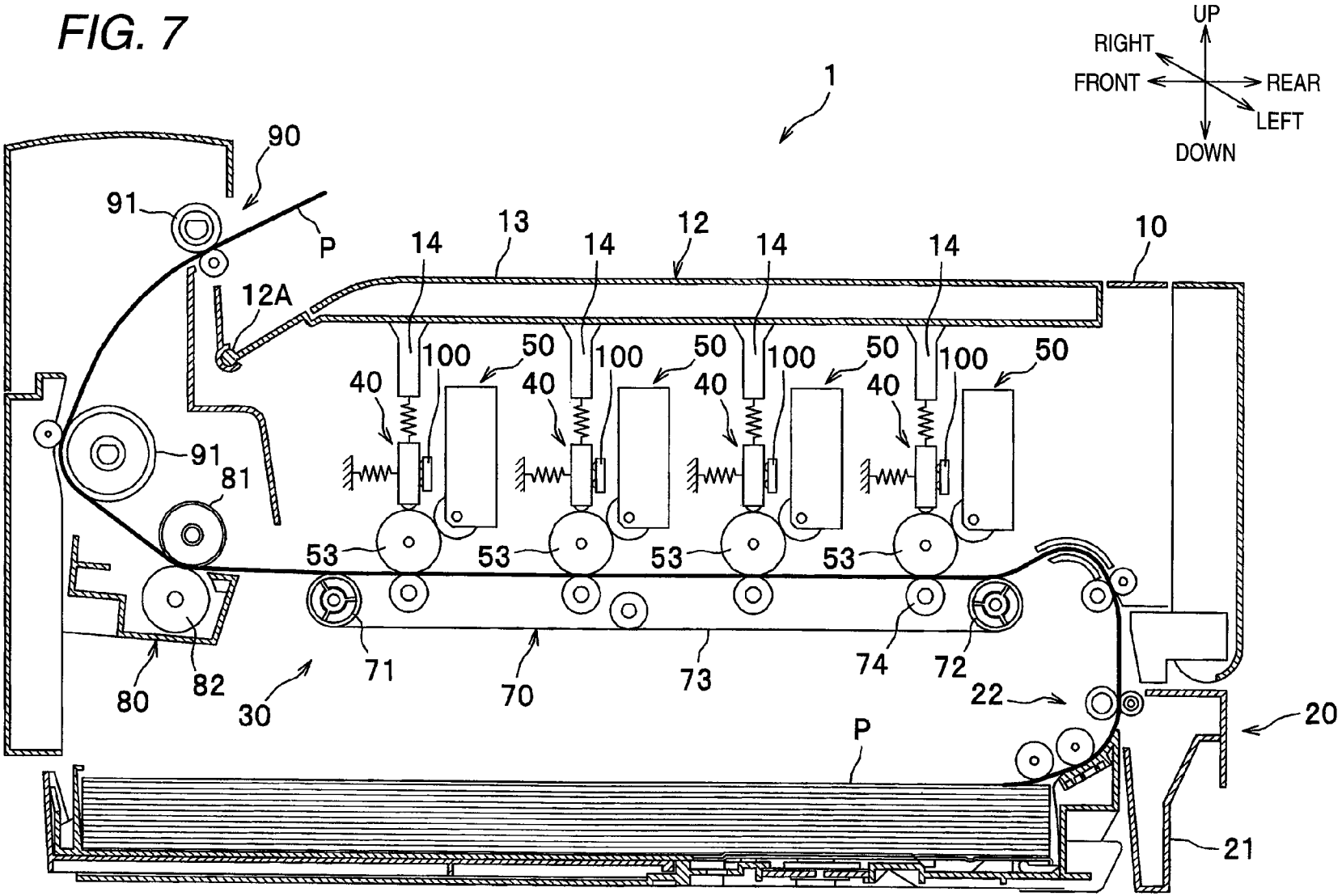
FIG. 7 is a sectional view illustrating the entire configuration of a color printer according to a second embodiment of the invention.

A second embodiment of the invention will be described in detail with reference to FIGS. 7 to 12. FIG. 7 is a sectional view illustrating the entire configuration of a color printer. Elements of the second embodiment having the same functions as the elements of the first embodiment will be referenced by like reference numerals and the repeated description thereof will be omitted.

Configuration of Positioning Member

Figure 8:
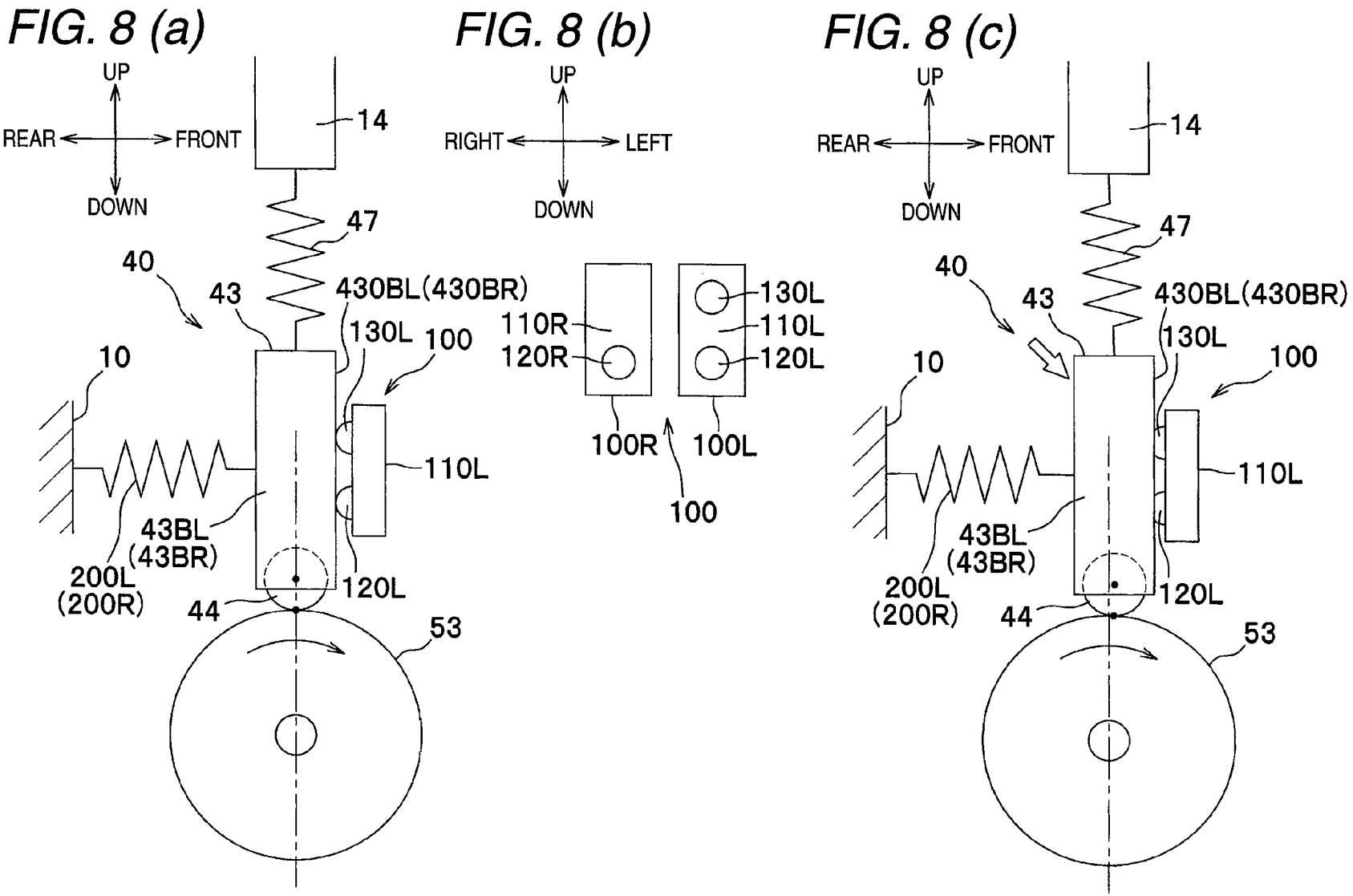
FIGS. 8(*a*), 8(*b*), and 8(*c*) show a positioning member, where FIG. 8(*a*) is a side view illustrating a state where the positioning member is not abraded, FIG. 8(*b*) is a rear view of the positioning member as viewed from the rear side, and FIG. 8(*c*) is a side view illustrating a state where the positioning member is abraded.
Figure 9:
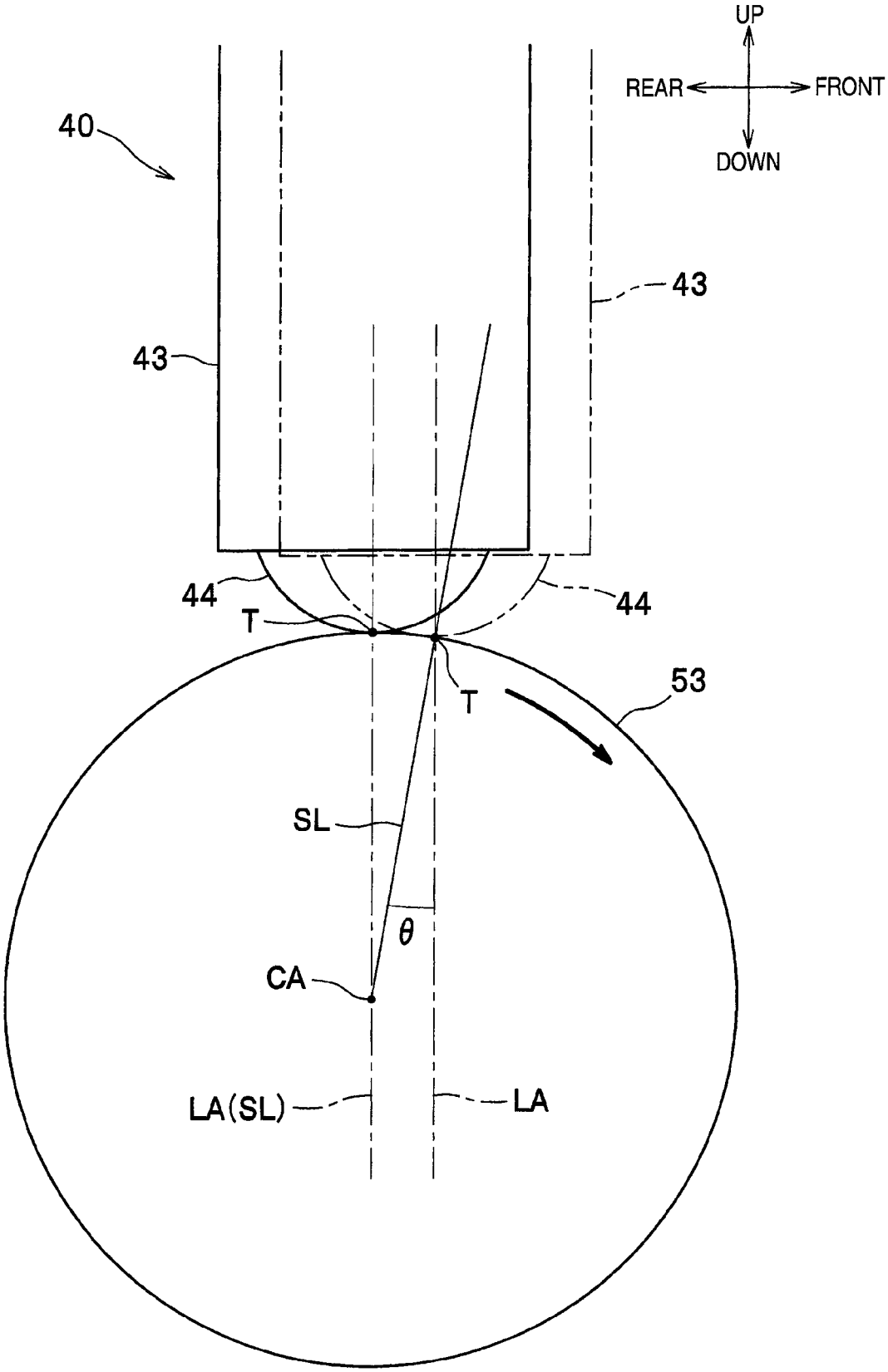
FIG. 9 is a side view illustrating an angle formed by a straight line connecting a contact point of a photosensitive drum and a guide roller and a center axis of the photosensitive drum and an optical axis.
Figure 10:
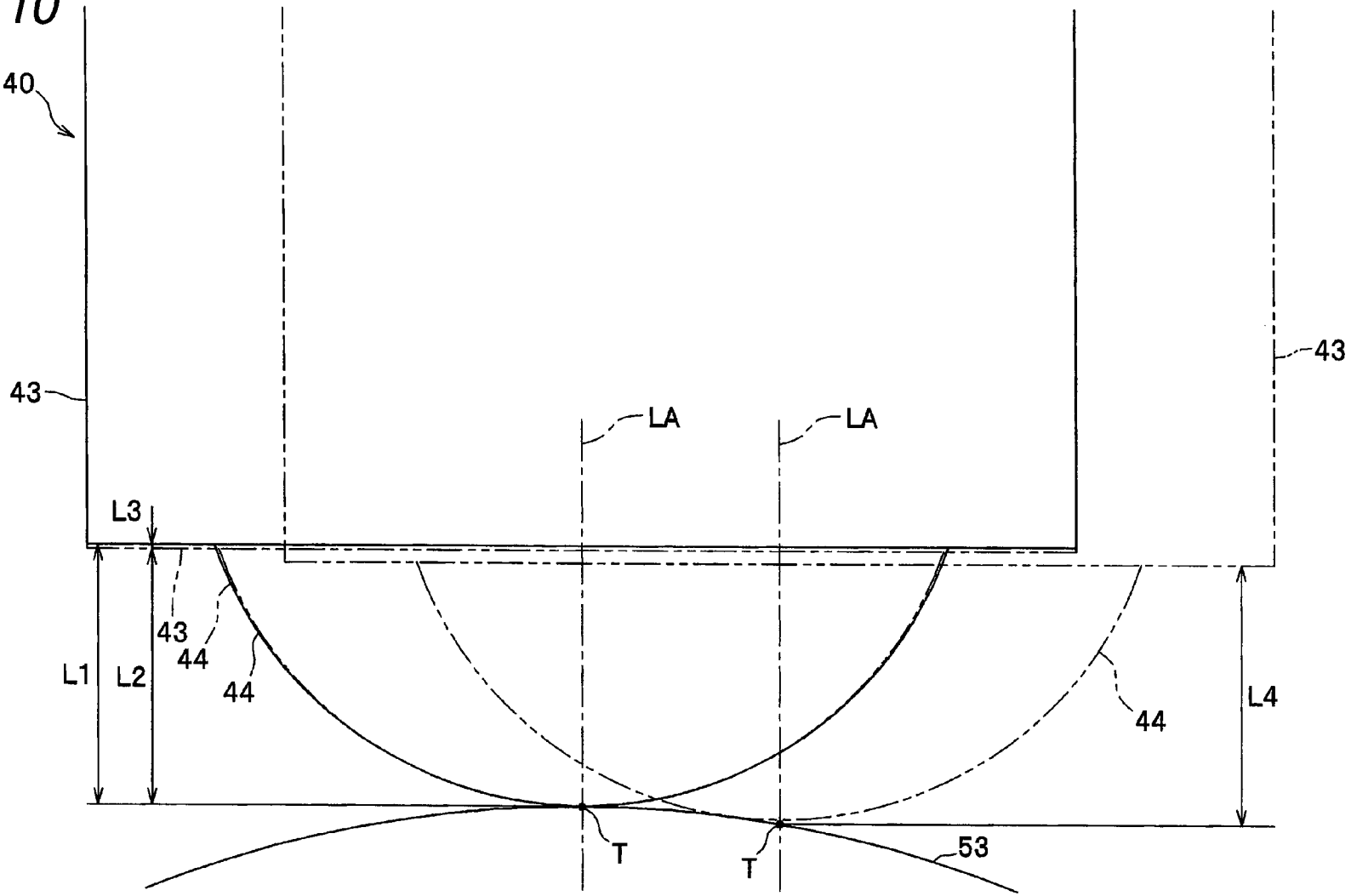
FIG. 10 is an enlarged view illustrating a relation between an abrasion distance of the guide roller and a distance in the optical axis direction between the guide roller and the photosensitive drum.

FIGS. 8(*a*), 8(*b*), and 8(*c*) are diagrams illustrating the configuration of the positioning member 100 according to the second embodiment, where FIG. 8(*a*) is a side view illustrating a state where the positioning member is not abraded, FIG. 8(*b*) is a rear view of the positioning member as viewed from the rear side, and FIG. 8(*c*) is a side view illustrating a state where the positioning member is abraded. FIG. 9 is a side view illustrating an angle formed by a straight line connecting a contact point of the photosensitive drum with the guide rollers and the center axis of the photosensitive drum and an optical axis and FIG. 10 is an enlarged view illustrating a relation between the abrasion distance of the guide rollers and the distance in the optical axis direction between the guide rollers and the photosensitive drum.

As shown in FIG. 8(*a*), the positioning member 100 is disposed in front of the LED unit 40 (downstream in the rotation direction of the photosensitive drum 53 from the exposure position T) to position the LED unit 40 in the front and rear directions (in the rotation direction of the photosensitive drum 53 at the exposure position T). Specifically, the positioning member 100 is disposed to be opposed to the front surfaces (one surface) 430BL and 430BR of the extension portions 43B of the support frame 43 constituting the LED unit 40.

Here, the exposure position T in the photosensitive drum 53 means a position where it is exposed to light emitted from the light emitting portions of the LED head 41, and more specifically, means an intersection of the optical axis of light and the outer circumferential surface of the photosensitive drum. However, when the light emitting portions of the LED head 41 are arranged in the front and rear directions, the photosensitive drum 53 is exposed with a width in the front and rear directions. In this case, the exposure position T means the center of the width in the front and rear directions.

Specifically, as shown in FIG. 8(*b*), the positioning member 100 includes a positioning member 100L coming in contact with the front surface 430BL of the left extension portion 43BL of the support frame 43 and a positioning member 100R coming in contact with the front surface 430BR of the right extension portion 43BR.

The left positioning member 100L includes a plate-like base portion 110L fixed to the main chassis 10, a movement regulating portion 120L formed in the lower portion of the rear surface of the base portion 110L, and an inclination regulating portion 130L formed in the upper portion of the rear surface of the base portion 110L.

The movement regulating portion 120L is a semispherical (tapered) protrusion protruding backward from the rear surface of the base portion 110L and comes in contact with a portion of the front surface 430BL of the extension portion 43BL close to the photosensitive drum 53. On the other hand, the inclination regulating portion 130L is a semispherical (tapered) protrusion protruding backward from the rear surface of the base portion 110L and is disposed to overlap with the movement regulating portion 120L as viewed in the vertical direction. The inclination regulating portion 130L comes in contact with a portion of the front surface 430BL of the extension portion 43BL more apart from the photosensitive drum 53 than the portion coming in contact with the movement regulating portion 120L.

The right positioning member 100R includes a plate-like base portion 110R fixed to the main chassis 10 and a movement regulating portion 120R formed in the lower portion of the rear surface of the base portion 110R. The movement regulating portion 120R is a semispherical (tapered) protrusion protruding backward from the rear surface of the base portion 110R and comes in contact with a portion of the front surface 430BR of the extension portion 43BR close to the photosensitive drum 53. The right movement regulating portion 120R is disposed to overlap with the left movement regulating portion 120L as viewed in the lateral direction.

The movement regulating portions 120L and 120R and the inclination regulating portion 130L formed of tapered protrusions are more easily abraded than the front surface of the support frame 43 (the extension portions 43B) having a plane shape. Specifically, in this embodiment, by mixing abrasive powder abrading the positioning member 100 into the resin support frame 43, the positioning member 100 is more easily abraded than the support frame 43. An example of the abrasive powder includes a mineral or a glass fiber. To more easily abrade the positioning member 100, for example, a method of forming the positioning member 100 out of a material more easily abraded than that of the support frame 43 or a method of setting the surface roughness of the support frame 43 to be smaller than that of the movement regulating portions 120L and 120R and the inclination regulating portion 130L may be employed.

The opposite side of the positioning member 100 about the LED unit 40 is provided with second coil springs 200L and 200R pressing the LED unit 40 to the positioning member 100. Specifically, the second coil springs 200L and 200R are fixed to the main chassis 10, the left second coil spring 200L presses the rear surface of the extension portion 43BL to the positioning member 100L, and the right second coil spring 200R presses the rear surface of the extension portion 43BR to the positioning member 100R.

The second coil spring 200L is disposed at a position between the movement regulating portion 120L and the inclination regulating portion 130L in the vertical direction (in the optical axis direction) and is disposed to overlap with the positioning member 100L as viewed in the front and rear directions. The second coil spring 200R is disposed at a position between the movement regulating portion 120R(L) and the inclination regulating portion 130L in the vertical direction (in the optical axis direction) and is disposed to overlap with the positioning member 100R as viewed in the front and rear directions.

By disposing the LED unit 40, the positioning member 100, the first coil spring 47, and the second coil springs 200L and 200R as shown in FIG. 8(*c*), the LED unit 40 is pressed to move down obliquely to the front side by the first coil spring 47 and the second coil springs 200L and 200R, when the guide rollers 44 of the LED unit 40 and the positioning member 100 (the movement regulating portions 120L and 120R and the inclination regulating portion 130L) are abraded.

Specifically, as shown in FIG. 9 as the guide rollers 44 move down obliquely to the front side along the outer circumferential surface of the photosensitive drum 53, (the absolute value of) an angle θ formed by a straight line SL connecting the exposure position T of the photosensitive drum 53 and the center axis CA of the photosensitive drum 53 in the diameter direction of the photosensitive drum 53 and an optical axis LA slowly increases.

Here, the angle θ formed by the straight line SL and the optical axis LA includes two kinds of an acute angle and an obtuse angle, but means the acute angle in this embodiment as shown in the drawing. In other words, the angle θ formed by the straight line SL and the optical axis LA means an angle interposed between the straight line SL and the optical axis LA in the rotation direction of the photosensitive drum 53.

Operations of the LED unit 40, the positioning member 100, the first coil spring 47, and the second coil springs 200L and 200R arranged as described above will be described now in detail.

As shown in FIG. 10, when the guide roller 44 and the photosensitive drum 53 come in slide-contact with each other by the rotation of the photosensitive drum 53 and thus the guide roller 44 is abraded, a distance L1 in the optical axis direction between the lower end of the support frame 43 and the exposure position T is reduced to a distance L2 by the abrasion distance L3. In this way, by lowering the position of the support frame 43 by the distance L3, the operating distance S (see FIG. 2) is reduced by the distance L3.

On the other hand, since the surface of the photosensitive drum 53 is not formed in a perfect circle due to manufacturing errors or technical limits, the guide roller 44 following the surface of the photosensitive drum 53 vertically vibrate with the rotation of the photosensitive drum 53. At this time, the support frame 43 and the positioning member 100 slide each other and thus the positioning member 100 is abraded.

In this way, when the positioning member 100 (the movement regulating portions 120L and 120R and the inclination regulating portion 130L) is abraded, the guide roller 44 (the light emitting portions of the LED head 41) moves down obliquely to the front side along the outer circumferential surface of the photosensitive drum 53. When the guide roller 44 moves as described above, (the absolute value of) the angle θ formed by the optical axis LA of the light emitted from the light emitting portions of the LED head 41 and the straight line SL connecting the center axis CA of the photosensitive drum 53 and the exposure position T of the photosensitive drum 53 slowly increases (see FIG. 9). Accordingly, the operating distance S in the optical axis direction between the light emitting portions of the LED head 41 and the photosensitive drum 53 increases.

By properly setting the materials of the guide rollers 44, the support frame 43, and the positioning member 100, the distance in the optical axis direction between the lower end of the support frame 43 and the exposure position T of the photosensitive drum 53 can be kept substantially constant (L1≈L4) before and after the abrasion, thereby suppressing the variation of the operating distance S.

According to the above-mentioned configuration, the following advantages can be obtained in the second embodiment.

By allowing the guide rollers 44 to move along the photosensitive drum 53 with the abrasion of the guide rollers 44 to increase the distance in the optical axis direction between the guide rollers 44 and the exposure position T of the photosensitive drum 53, the variation of the operating distance S can be suppressed, thereby improving the image quality.

Since the movement regulating portions 120L and 120R are disposed in the lower portion of the positioning member 100 and the inclination regulating portion 130L is disposed in the upper portion thereof, it is possible to suppress the LED unit 40 from being inclined about the movement regulating portions 120L and 120R by the use of the inclination regulating portion 130L in the example where the portion of the LED unit 40 above the movement regulating portions 120L and 120R is pressed by the second coil springs 200L and 200R.

Since the movement regulating portions 120L and 120R and the inclination regulating portion 130L as tapered protrusions are more easily abraded than the front surface of the support frame 43 as a plane, the tapered protrusions are slowly abraded and the front end is changed to a plane, whereby the plane and the plane can slide each other. Accordingly, it is possible to allow the LED unit 40 to smoothly move in the vertical direction (in the direction directed to the photosensitive drum 53).

Since the abrasive powder abrading the positioning member 100 is mixed into the support frame 43, the movement regulating portions 120L and 120R and the inclination regulating portion 130L of the positioning member 100 can be satisfactorily abraded, thereby surely obtaining the above-mentioned advantages.

Since the movement regulating portions 120L and 120R are formed by two protrusions offset in the lateral direction and the inclination regulating portion 130L is formed by one protrusion, the LED unit 40 can be stably supported at three points.

The invention is not limited to the second embodiment, but may be modified in various forms as described below.

In the second embodiment, the positioning member 100 is disposed only in front of the LED unit 40, but the invention is not limited to this configuration. For example, as shown in FIG. 11(*a*), the positioning member may be formed by members (a first member 300 and a second member 400) interposing the support frame 43 of the LED unit 40 therebetween in the front and rear directions (in the rotation direction of the photosensitive drum 53).

Figure 11:
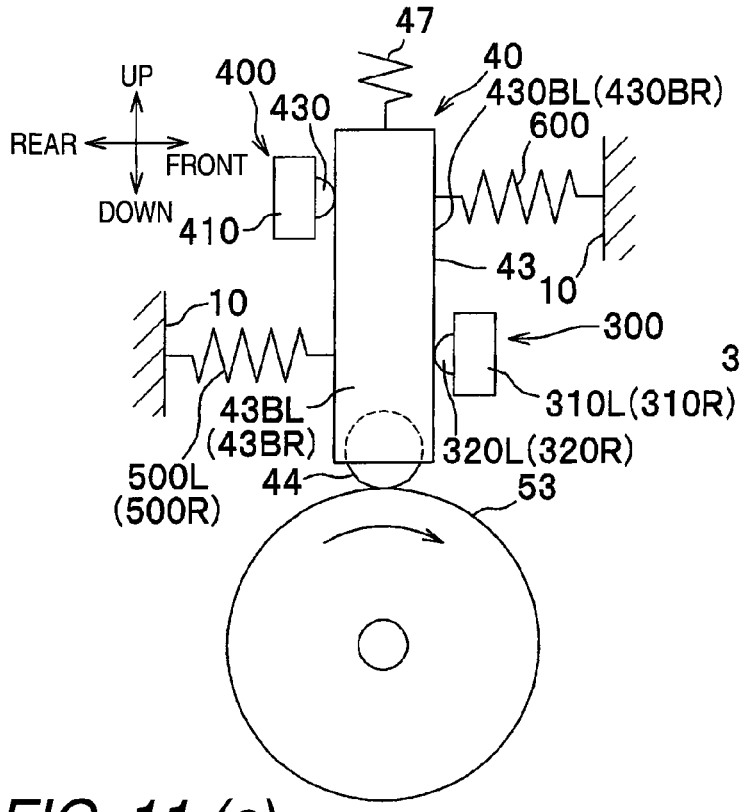
FIGS. 11(*a*), 11(*b*), and 11(*c*) show a modified example of the positioning member, where FIG. 11(*a*) is a side view illustrating a state where the positioning member is not abraded, FIG. 11(*b*) is a rear view of a first member as viewed from the rear side, and FIG. 11(*c*) is a side view illustrating a state where the positioning member is abraded.
Figure 11:
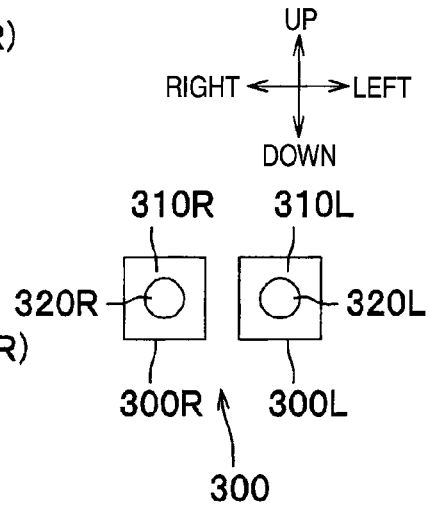
Figure 11:
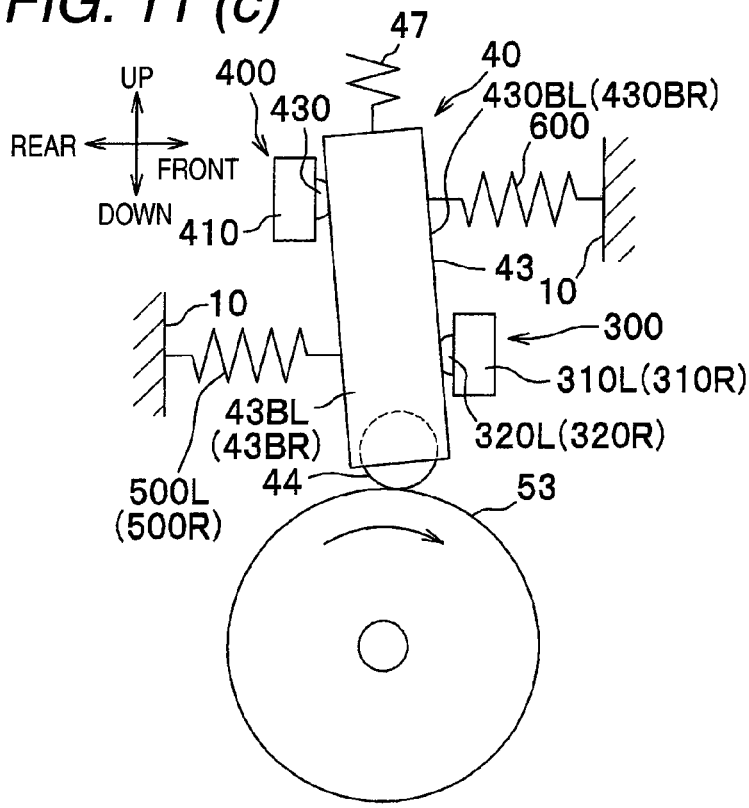

Specifically, the first member 300 is disposed in front of the extension portion 43B of the support frame 43 (downstream in the rotation direction of the photosensitive drum 53) and includes a first member 300L coming in contact with the front surface 430BL of the left extension portion 43BL and a first member 300R coming in contact with the front surface 430BR of the right extension portion 43BR, as shown in FIG. 11(*b*).

The left first member 300L includes a plate-like base portion 310L fixed to the main chassis 10 and a movement regulating portion 320L protruding in a semicircular shape from the rear surface of the base portion 310L. Similarly, the right first member 300R includes a plate-like base portion 310R fixed to the main chassis 10 and a movement regulating portion 320R protruding in a semicircular shape from the rear surface of the base portion 310R.

The movement regulating portions 320R and 320L are disposed to overlap with each other on the side of the support frame 42 close to the photosensitive drum 53 as viewed in the lateral direction (is disposed at the same position in the vertical direction).

The second member 400 is disposed in back of the left extension portion 43BL and includes a plate-like base portion 410 fixed to the main chassis 10 and an inclination regulating portion 430 formed on the front surface of the base portion 410. The inclination regulating portion 430 is a semispherical (tapered) protrusion protruding forward and comes in contact with a portion of the extension portion 43BL of the support frame 43 more apart from the photosensitive drum 53 than the portion coming in contact with the movement regulating portion 320L.

The movement regulating portions 320R and 320L and the inclination regulating portion 430 are more easily abraded than the support frame 43 (the front surface 430BL and the rear surface of the extension portion 43BL and the front surface 430BR of the extension portion 43BR).

The side of the first member 300 about the LED unit 40 is provided with third coil springs 500R and 500L and the side of the second member 400 about the LED unit 40 is provided with a fourth coil spring 600.

The right third coil spring 500R is disposed to press the rear surface (the LED unit 40) of the right extension portion 43BR of the support frame 43 to the movement regulating portion 320R. The left third coil spring 500L is disposed to press the rear surface of the extension portion 43BL to the movement regulating portion 320L.

The third coil spring 500R is fixed to the main chassis 10 and is disposed at the same position as the movement regulating portion 320R in the vertical direction (in the optical axis direction). Specifically, the operating portion (the contact portion with the extension portion 43BR) of the third coil spring 500R is disposed at the same position as the contact portion of the movement regulating portion 320R with the extension portion 43BR in the vertical direction. The operating portion of the third coil spring 500R may be disposed below the contact portion of the movement regulating portion 320R (close to the photosensitive drum).

Similarly, the third coil spring 500L is fixed to the main chassis 10 and is disposed at the same position as the movement regulating portion 320L in the vertical direction (in the optical axis direction). Specifically, the operating portion (the contact portion with the extension portion 43BL) of the third coil spring 500L is disposed at the same position as the contact portion of the movement regulating portion 320L with the extension portion 43BL in the vertical direction. The operating portion of the third coil spring 500L may be disposed below the contact portion of the movement regulating portion 320L (close to the photosensitive drum).

The fourth coil spring 600 is a spring pressing the rear surface (the LED unit 40) of the extension portion 43BL of the support frame 43 to the inclination regulating portion 430 of the second member 400 and is fixed to the main chassis 10. The fourth coil spring 600 is disposed at the same position as the inclination regulating portion 430 in the vertical direction. Specifically, the operating portion of the fourth coil spring 600 is disposed at the same position as the contact portion of the inclination regulating portion 430 with the LED unit 40 in the vertical direction. The operating portion of the fourth coil spring 600 may be disposed above the contact portion of the inclination regulating portion 430 (apart from the photosensitive drum 53).

According to the above-mentioned configuration, as shown in FIG. 11(*c*), when the guide roller 44, the first member 300 (the movement regulating portions 320R and 320L), and the second member 400 (the inclination regulating portion 430) are abraded, the LED unit 40 (optical axis) is inclined oblique about the vertical direction.

Figure 12:
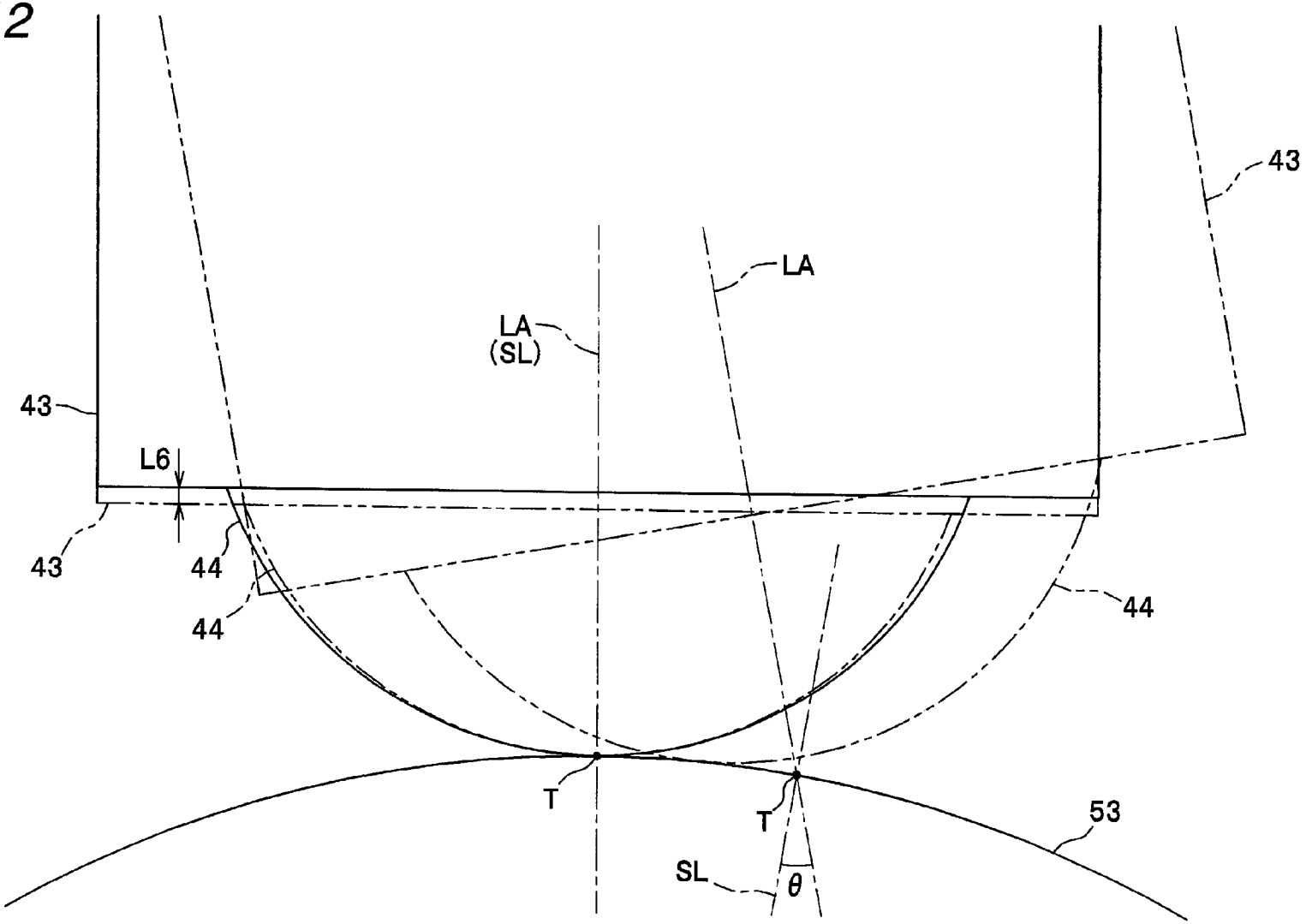
FIG. 12 is an enlarged view illustrating a relation between an abrasion distance of the guide roller and a distance in the optical axis direction between the guide roller and the photosensitive drum in the modified example shown in FIG. 11.

That is, as shown in FIG. 12, when the guide roller 44 is abraded by an abrasion distance L6 greater than that of the second embodiment (see FIG. 10), it is necessary to further increase the moving distance of the guide roller 44 in the above-mentioned embodiment. On the contrary, in the modified example shown in FIG. 12, since the optical axis LA is inclined, (the absolute value of) the angle θ formed by the straight line SL connecting the exposure position T of the photosensitive drum 53 and the center axis CA of the photosensitive drum 53 and the optical axis LA can be increased by only slightly abrading the first member 300 and the second member 400. In this way, by allowing the guide roller 44 to move by a short distance, it is possible to suppress the variation of the operating distance S.

In the modified example shown in FIG. 12, since the movement regulating portions 320R and 320L and the inclination regulating portion 430 are disposed as described above, it is possible to prevent the lower end (the guide rollers 44) of the LED unit 40 from being attracted in the rotation direction of the photosensitive drum 53 due to the friction with the photosensitive drum 53 to excessively incline the LED unit 40 about the movement regulating portions 320R and 320L by the use of the inclination regulating portion 430, in a state where the movement regulating portions 320R and 320L are not abraded.

Since the operating portions of the third coil spring 500R and 500L are disposed at the same positions as the contact portions of the movement regulating portions 320R and 320L in the vertical direction, it is possible to suppress the LED unit 40 from being inclined about the movement regulating portions 320 by the use of the urging force of the third coil springs 500R and 500L, compared with the structure in which the operating portion of the third coil spring 500 is disposed above the contact portions of the movement regulating portions 320R and 320L. When the operating portions of the third coil springs 500R and 500L are disposed below the contact portions of the movement regulating portions 320R and 320L, it is possible to satisfactorily press the LED unit 40 to the movement regulating portions 320R and 320L and the inclination regulating portion 430 by the use of the single third coil spring 500.

Since the operating portion of the fourth coil spring 600 is disposed at the same position as the contact portion of the inclination regulating portion 430 in the vertical direction, it is possible to suppress the LED unit 40 from being inclined about the inclination regulating portion 430 by the use of the urging force of the fourth coil spring 600, compared with the structure in which the operating portion of the fourth coil spring 600 is disposed below the contact portion of the inclination regulating portion 430. When the operating portion of the fourth coil spring 600 is disposed above the contact portion of the inclination regulating portion 430, it is possible to satisfactorily press the LED unit 40 to the movement regulating portions 320R and 320L and the inclination regulating portion 430 by the use of the single fourth coil spring 600.

In the second embodiment, the positioning member 100 is more easily abraded than the support frame 43, but the invention is not limited to this configuration. For example, the support frame 43 may be more easily abraded than the positioning member 100. Accordingly, since the color printer 1 can be returned to a new product state by only replacing the support frame 43 instead of replacing the positioning member 100 accurately positioned and fixed to the main chassis 10, it is possible to replace the abraded component without performing the complex positioning operation.

In the second embodiment, the LED unit 40 having the LED head 41 and the support frame 43 is employed as the exposure member, but the invention is not limited to this configuration. For example, the LED head 41 may be employed as the exposure member. That is, the guide rollers 44 as the gap keeping member may be rotatably disposed in the LED head 41 and the LED head 41 may be urged to the photosensitive drum 53 and the positioning member 100.

In the second embodiment, the positioning member 100 is disposed more downstream in the rotation direction of the photosensitive drum 53 than the LED unit 40, but the invention is not limited to this configuration. The positioning member 100 may be disposed more upstream in the rotation direction of the photosensitive drum 53 than the LED unit 40.

In the second embodiment, the LED unit 40 (specifically, the guide rollers 44) is located at the uppermost portion of the photosensitive drum 53 in the initial state, but the invention is not limited to this configuration. The LED unit 40 may be disposed at a position (for example, the position indicated by a two-dot chained line in FIG. 5) other than the uppermost portion of the photosensitive drum 53 in the initial state. In this case, when the positioning member 100 is disposed in back of the LED unit 40, (the absolute value of) the angle θ formed by the optical axis LA and the straight line SL gradually decreases and thus the advantages of the invention cannot be obtained. Accordingly, the positioning member 100 can be disposed in front of the LED unit 40.

In the second embodiment, plural protrusions are disposed in the positioning member 100 and the contact surface of the support frame 43 and the positioning member 100 is formed in a plane, but the invention is not limited to this configuration. Plural protrusions may be disposed in the support frame (the exposure member) and the positioning member may be formed in a plane.

In the second embodiment, the rotatable guide rollers 44 are employed as the gap keeping member, but the invention is not limited to this configuration. For example, a non-rotatable member such as a spacer having a concave surface coming in surface contact with the outer circumferential surface of the photosensitive drum may be employed as the gap keeping member. In this case, the exposure member, the positioning member, and the pressing member can be disposed so that the angle formed by the optical axis of the exposure member and the straight line connecting the center axis of the photosensitive drum and the exposure position slowly increases as the positioning member or the exposure member is abraded.

In the second embodiment, two elastic members (the first coil spring 47 and the second coil springs 200L and 200R) are employed as the pressing member, but the invention is not limited to this configuration. The pressing member may be formed by a single elastic member. Specifically, for example, a single elastic member pressing the LED unit to the photosensitive drum 53 and the positioning member 100 by urging the LED unit 40 obliquely downward to the front side in FIGS. 8(*a*), 8(*b*), and 8(*c*) may be employed. The elastic member is not limited to the coil spring, but may employ a leaf spring or a torsion spring.

In the first embodiment and the second embodiment, the LED head 41 having the plural LED arrays 41A arranged in a line in the lateral direction is employed as one constituent element of the exposure member, but the invention is not limited to this configuration. For example, an LED head having plural lines in the front and rear directions in which plural LEDs are arranged in the lateral direction may be employed. A structure may be employed which includes plural light emitting portions formed by one light emitting element such as an LED or a fluorescent lamp and an optical shutter of plural liquid crystal or PLZT elements arranged in the lateral direction outside the light emitting element. The light source is not limited to the LED, but may include an electroluminescence (EL) element or a fluorescent member.

In the first embodiment and the second embodiment, the invention is applied to the color printer 1, but the invention is not limited to it. The invention may be applied to other image forming apparatuses such as a copier or a multifunction machine.

As discussed above, the invention can provide at least the following illustrative, non-limiting embodiments:

(1) An image forming apparatus including: a rotatable photosensitive member; an exposure member configured to expose the photosensitive member; a gap keeping member disposed on the exposure member and configured to come in contact with the photosensitive member to keep a gap between the exposure member and the photosensitive member; a positioning member disposed more downstream than the exposure member in a rotation direction of the photosensitive member and configured to come in contact with the exposure member to position the exposure member in the rotation direction; and a swing regulating member configured to come in contact with the exposure member at a contact position to regulate a swing of the exposure member about the positioning member, wherein the contact position between the swing regulating member and the exposure member is more upstream than the exposure member in the rotation direction and at a position more separated from the photosensitive member than a contact position between the positioning member and the exposure member.

In the image forming apparatus according to (1), even when the gap keeping member coming in contact with the rotating photosensitive member is attracted in the rotation direction of the photosensitive member due to the friction with the photosensitive member and thus the exposure member tends to swing about the positioning member, the swing of the exposure member is suppressed by the swing regulating member, thereby suppressing the inclination of the exposure member. Accordingly, since the focal position of light emitted from the exposure member is suppressed from offset, it is possible to improve the image quality.

(2) An image forming apparatus including: a rotatable photosensitive drum having a cylindrical surface; an exposure member configured to expose the photosensitive drum; a gap keeping member disposed on the exposure member and configured to come in contact with the photosensitive drum to keep a gap between the exposure member and the photosensitive drum; a positioning member configured to come in contact with the exposure member to position the exposure member in a rotation direction of the photosensitive drum; and a pressing member configured to press the exposure member to the photosensitive drum and the positioning member, wherein the exposure member, the positioning member, and the pressing member are configured so that an angle formed by a straight line connecting a center axis of the photosensitive drum and an exposure position of the photosensitive drum and an optical axis of light emitted from the exposure member increases as an abrasion of the gap keeping member and an abrasion of the exposure member or the positioning member increase.

In the image forming apparatus according to (2), when the gap keeping member comes in slide-contact with the photosensitive drum by the rotation of the photosensitive drum and thus the gap keeping member is abraded, the gap in the optical axis direction between the light emitting portions of the exposure member and the photosensitive drum is reduced by the abrasion distance. On the other hand, the positioning member or the exposure member is also abraded and thus the gap keeping member moves along the outer circumferential surface of the photosensitive drum to increase the angle formed by the optical axis of light emitted from the exposure member and the straight line connecting the center axis of the photosensitive drum and the exposure position of the photosensitive drum. Accordingly, the gap in the optical axis direction between the light emitting portions of the exposure member and the photosensitive drum is enlarged.

Therefore, by setting the materials of the gap keeping member and the like so that the abrasion distance of the gap keeping member and the distance in the optical axis direction between the gap keeping member and the photosensitive drum properly increase with the movement of the gap keeping member, it is possible to suppress the variation in gap in the optical axis direction between the photosensitive drum and the exposure member.

What is claimed is:

1. An image forming apparatus comprising:

a rotatable photosensitive member;

an exposure member configured to expose the photosensitive member;

a gap keeping member disposed on the exposure member and configured to come in contact with the photosensitive member to keep a gap between the exposure member and the photosensitive member, a positioning member disposed more downstream than the exposure member in a rotation direction of the photosensitive member and configured to come in contact with the exposure member to position the exposure member in the rotation direction; and a swing regulating member configured to come in contact with the exposure member at a contact position to regulate a swing of the exposure member about the positioning member, wherein the contact position between the swing regulating member and the exposure member is more upstream than the exposure member in the rotation direction and more separated from the photosensitive member than a contact position between the positioning member and the exposure member.

2. The image forming apparatus according to claim 1, further comprising a first pressing member configured to press the exposure member to the positioning member, wherein the first pressing member is disposed at a position the same as the positioning member in an optical axis direction of light emitted from the exposure member, or at a position closer to the photosensitive member than the positioning member in the optical axis.

3. The image forming apparatus according to claim 2, further comprising a second pressing member configured to press the exposure member to the swing regulating member, wherein the second pressing member is disposed at a position the same as the swing regulating member in an optical axis direction of light emitted from the exposure member, or at a position more separated from the photosensitive member than the swing regulating member in the optical axis direction.

4. The image forming apparatus according to claim 3, wherein the first pressing member is attached to a chassis of the apparatus, and the second pressing member is attached to the exposure member.

5. The image forming apparatus according to claim 2, wherein the exposure member, the positioning member, and the first pressing member are configured so that an angle formed by a straight line connecting a center axis of the photosensitive member and an exposure position of the photosensitive member and an optical axis of light emitted from the exposure member increases as an abrasion of the gap keeping member and an abrasion of the exposure member or the positioning member increase.

6. An image forming apparatus comprising:

a rotatable photosensitive drum having a cylindrical surface;

an exposure member configured to expose the photosensitive drum;

a gap keeping member disposed on the exposure member and configured to come in contact with the photosensitive drum to keep a gap between the exposure member and the photosensitive drum;

a positioning member configured to come in contact with the exposure member to position the exposure member in a rotation direction of the photosensitive drum; and a pressing member configured to press the exposure member to the photosensitive drum and the positioning member, wherein the exposure member, the positioning member, and the pressing member are configured so that an angle formed by a straight line connecting a center axis of the photosensitive drum and an exposure position of the photosensitive drum and an optical axis of light emitted from the exposure member increases as an abrasion of the gap keeping member and an abrasion of the exposure member or the positioning member increase.

7. The image forming apparatus according to claim 6, wherein the positioning member includes a single integral member facing one surface of the exposure member and the single integral member includes:

a movement regulating portion configured to come in contact with a first portion of the one surface; and an inclination regulating portion configured to come in contact with a second portion of the one surface, the second portion being more separated from the photosensitive drum than the first portion.

8. The image forming apparatus according to claim 7, wherein the movement regulating portion includes two protrusions disposed away from each other in an axis direction of the photosensitive drum and the inclination regulating portion includes one protrusion.

9. The image forming apparatus according to claim 6, wherein the positioning member includes first and second members interposing the exposure member therebetween, and wherein the first member includes a movement regulating portion configured to come in contact with a first portion of the exposure member and the second member includes an inclination regulating portion configured to come in contact with a second portion of the exposure member, the second portion being more separated from the photosensitive drum than the first portion.

10. The image forming apparatus according to claim 9, wherein the pressing member includes:

a first pressing member configured to press the exposure member to the photosensitive drum; and a second pressing member configured to press the exposure member to the movement regulating portion, and wherein the second pressing member is disposed at the same position as the movement regulating portion in an optical axis direction of light emitted from the exposure member.

11. The image forming apparatus according to claim 6, wherein one of the positioning member and the exposure member includes abrasive powder for abrading the other.

12. The image forming apparatus according to claim 6, wherein the exposure member is more easily abraded than the positioning member.

13. The image forming apparatus according to claim 6, wherein one of contact portions of the positioning member and the exposure member is formed as a plane and the other is formed as a tapered protrusion coming in contact with the plane, and wherein the protrusion is more easily abraded than the plane.

* * * * *